US005388893A

United States Patent [19]

Maxwell et al.

[11] Patent Number: 5,388,893

[45] Date of Patent: Feb. 14, 1995

[54] PAVEMENT GRINDER AND TRENCH OPENING MILL AND METHOD

[76] Inventors: James F. Maxwell, 722 E. 2730 North, Provo, Utah 84604; Garlon J. Maxwell, 2260 S. State, Springville, Utah 84663

[21] Appl. No.: 69,776

[22] Filed: Jun. 1, 1993

[51] Int. Cl.[6] ..... F01C 23/12; F02F 3/78

[52] U.S. Cl. ..... 299/39; 37/403; 37/903

[58] Field of Search ..... 299/39, 67, 58; 404/90; 37/903, 403

[56] References Cited

U.S. PATENT DOCUMENTS

| | | | |
|---|---|---|---|
| 3,606,469 | 9/1971 | Hughes | 299/39 |
| 3,864,793 | 2/1975 | Guest | 37/403 X |
| 4,411,081 | 10/1983 | King | 37/903 |
| 4,704,045 | 11/1987 | Taylor et al. | 299/39 X |
| 4,803,789 | 2/1989 | Hackmack | 37/903 X |
| 5,060,732 | 10/1991 | Baskett | 37/903 X |

FOREIGN PATENT DOCUMENTS

| | | | |
|---|---|---|---|
| 3420989 | 12/1985 | Germany | 299/39 |
| 296847 | 7/1971 | U.S.S.R. | 404/90 |

*Primary Examiner*—David J. Bagnell

[57] ABSTRACT

A pavement trench mill is designed to be attached to the bucket of a front loader or backhoe. The pavement trench mill has a self contained engine to power the mandrel and is raised and lowered by the bucket on which it is mounted. The trench mill has a gauge that controls the depth of the cut. The cutting drum has a double cutting action which is provided by two sets of edge mounted teeth. The first set of edge mounted teeth are at the same radius and angle as the remainder of the mandrel cutting teeth. The second set of edge mounted teeth are spaced slightly wider (longitudinally) and slightly lower (closer to center of mandrel). This row of teeth trims the outer edge of the trench with greater frequency and leaves the edge smoother.

6 Claims, 1 Drawing Sheet

PAVEMENT GRINDER AND TRENCH OPENING MILL AND METHOD

BACKGROUND OF THE INVENTION

Asphalt pavement milling machines have been used for the past 15 years. During this time several companies have designed and manufactured machines for both large and small milling jobs. These machines have a common denominator of high horse power and very heavy weight for cutting speed and stability. They are designed mainly for the subcontractor which specializes in asphalt milling.

One of the major problems with self-propelled milling machines used for utility trenching is they seem to sit idle much of the time because the machine can pulverize asphalt much more rapidly than the pipe laying crew can lay pipe. Expensive pieces of equipment must be utilized more continuously in order to justify their purchase investment. These specialized machines also require a trained operator and mechanic in order to utilize them efficiently.

Another problem of self propelled machines is the transportability requiring a transport truck and low boy trailer to move it to a project of any size.

The serviceability of a specialized mill may be a significant deterrent to the popularity of these machines. Milling machines have had a history of being a high maintenance item. This is partly due to being only recently developed, working in an extreme environment, being very complex with many working parts, and being subject to severe vibration continually.

There are also a number of hydraulic attachment mills for small trimming and clean up jobs. These small hydraulic driven attachments powered by the tractor's own engine are uneconomical for long or deep cuts and can't get enough trench opened when working full time for an average pipe laying contractor. Most mills of this type can not cut more than a few inches deep which can not meet the contractor's requirements for the trenching application. Only tractors with hydrostatic drive capable of moving slowly at a controlled speed with engine at maximum idle to produce adequate hydraulic power for milling can be used for these types of mills. This excludes rubber tired backhoes and loaders, the most common equipment on utility projects. Because of the above stated reasons contractors are not frequently utilizing either the small hydraulic driven machines or the large self propelled milling machines but are usually using the old method of saw cutting and hauling away asphalt chunks.

A contractor needs to be able to pulverize the trench immediately ahead of the pipelaying crew in order to reduce road closure time and traffic congestion. Thus it is necessary to have a mill sitting at the job site through out the day even though it is often used less than 10% of the time. The availability of a loader or backhoe with front bucket on pipelaying projects and utility work makes it the ideal equipment to propel this unique milling attachment. Using the tractor as the motive power for milling is a new concept in the utility trenching industry.

After calling 500 contractors involved in cutting asphalt on water lines we found that over 90% didn't have pulverizing machines. Most of those who had pulverizing machines said they were not utilizing them enough hours of the day to justify the cost.

A machine with sufficient power and speed to do the asphalt cutting for pipe laying at a cost economical to the operation has not been available. As we have experimented with different attachable milling machines we have discovered that the relationship between horse power and production is non-linear at certain points to the extent that at certain levels a slight increase in horse power will greatly increase production. The machine of this invention was designed and built to stay above this critical point at all cutting depths within its capability (12").

The milling machines built thus far are very heavy to provide for stability. Milling machines tend to vibrate and also to propel themselves rapidly out of control on the cutting mandrel if they don't have sufficient traction and weight. Using the special hookup to the tractor and using the tractor as the motive power and stabilizing support of the milling attachment allows a small unit with high horse power to mill smoothly with precession and accuracy.

DESCRIPTION OF THE DRAWINGS

The invention will now be described further, with reference to the accompanying drawings, in which.

DESCRIPTION OF THE INVENTION

Figure 1:
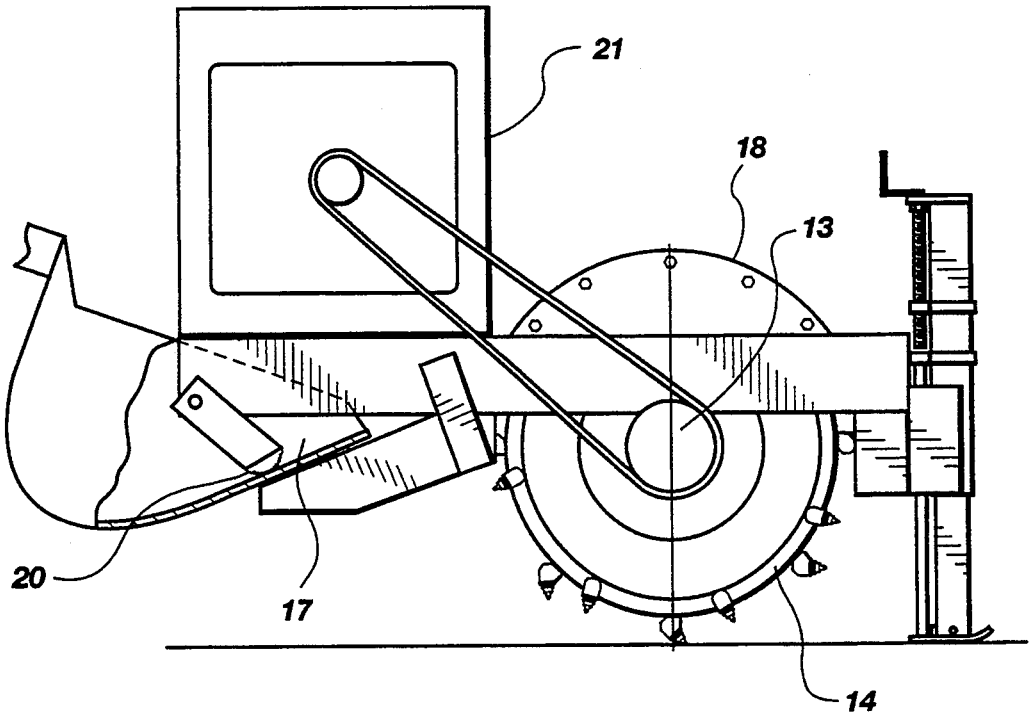
FIG. 1 is a side view of the machine of invention.
Figure 2:
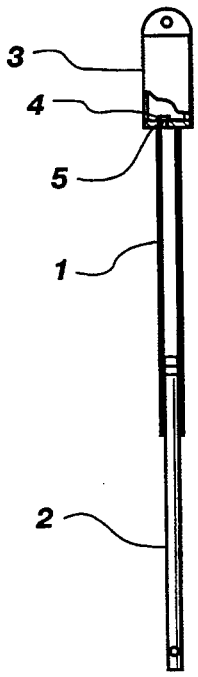
FIG. 2 is a cut away of dampening gauge showing piston and dampening cylinder.
Figure 3:
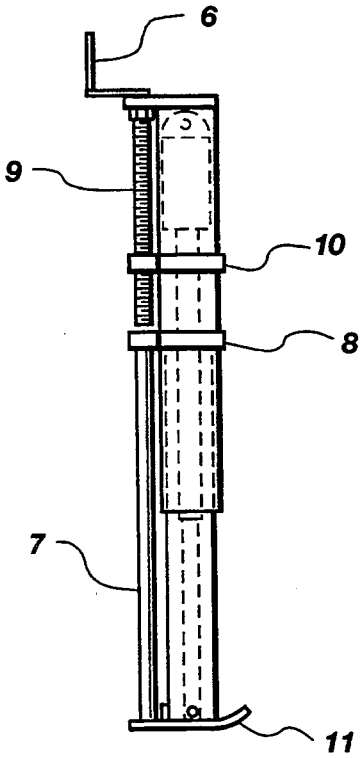
FIG. 3 is a side view of hydraulic dampener and depth adjustment gauge.

To attach the machine of invention to tractor the front bucket of loader or backhoe is inserted into angled opening 17 of frame and secured in place by locking dogs 20 which secure the machine to the bucket of a loader using a jaw with teeth similar to a large pipe wrench with a rounded edges so the teeth will contact the bucket surface regardless of its thickness. Said machine is lifted to milling site, engine 21 started and clutch engaged giving power to speed reduction box 13 and rotating mandrel 14. As machine is lowered to make cut the depth gauge shoes 11 contact pavement first to stabilize machine. The weight of said machine on depth gauge shoe 11 causes said depth gauges to retract at a slow rate regulated by the hydraulic dampeners located inside said depth gauges. Hydraulic dampener ram 2 is pushed into cylinder 1 slowly because small orifice 5 between cylinder 1 and oil reservoir 3 regulates movement at a predetermined rate due to orifice 5 size and viscosity of hydraulic oil confined in said cylinder. When machine is raised said depth gauge extends quickly because of a check valve 4 which allows oil to flow rapidly from reservoir into cylinder.

Depth of cut is adjusted or preadjusted by raising or lowering threaded rod adjustment block 10 by turning threaded rod 9 with a crank 6. As the mandrel 14 is cutting away the pavement to the desired depth, push rods 7 mounted to said depth gauge shoes 11 move guide block 8 towards adjustment block 8 until contact is made which stops retraction of depth gauges and holds said machine at preset depth until adjustment is made by turning depth gauge handles 6. Preferred depth is to mill all of the pavement and ½ to 2 inches of base allowing base material to cool the cutting teeth while milling. Machine is propelled forward by tractor to allow machine engine slowly enough to maintain its speed. Milled material is thrown over mandrel and contained by mandrel cover 18 and dropped into milled trench behind said mandrel.

Width of trench to be milled can by adjusted by adding or removing sections from the mandrel or by making multiple passes.

To couple a sturdy attachable mill to the front of a tractor which is usually available on trenching jobs makes sense in order to reduce initial cost, increase reliability and reduce down time, repair, and maintenance.

Because the weight of the trenching mill attachment is significantly lighter than the weight of prior art machines it is necessary to utilize the tractor mass and stability for support and mobility.

It was determined that to angle loader bucket at an angle upward from horizontal will accommodate a greater variety of loaders and backhoe buckets and also move the weight of the machine closer to the tractor.

The machine has a special double cutting action on each edge of the drum in order to make a rough enough cut to insure good bonding of asphalt when repaving trench but a smooth enough cut for a clean, uniform edge. The double cutting action first cuts the trench on each edge with teeth at the same radius and angle as the rest of the mandrel cutting pattern. This initial cut clears away the ground-up pavement making a straight outer edge. The said second set of edge mounted teeth are spaced slightly wider (longitudinally) and slightly lower (closer to center of mandrel). This row of teeth trims the outer edge of the trench with greater frequency and leaves the edge smoother because the uncut material is supported against breakage outward and relieved to provide for breakage into said trench for a smoother cut. This edge cutting method is highly desirable for trenching prior to utility installation under asphalt pavement which is the primary application for said machine.

A separate engine in the milling attachment allows for the engine in the propelling tractor to run at a slow speed, allowing said propelling tractor to move forward at any desired speed without damage to the torque converter or drive parts making it possible for almost any tractor with front lift and adequate size to be used with milling attachment.

The mandrel or cutting head is bolted to and supported by the output shaft of the planetary gear box mounted on bearing and is made up in several sections. Said sections or rings with cutting teeth can be added or removed with bolts easily to obtain any cutting width desired from a few inches up to several feet.

The internal combustion engine is mounted parallel to the mandrel with power take off shaft and belt pulley directly above and behind (closer to the tractor bucket mount) the input shaft and belt pulley of the planetary gear box. A multi-strand belt sufficient to transmit the full power of said engine is used to drive the mandrel. The preferred embodiment for proper tension of said belt is obtained by use of an idler pulley putting pressure against the bottom (slack side) of the belt or by sliding the engine.

We claim

1. A pavement trench opening mill attachable to a bucket of a back hoe or a front loader comprising;

a frame;

attachment means for firmly securing said pavement trench mill to said bucket;

a mandrel cutting head having attached thereto cutting teeth designed for pulverizing asphalt and cement pavement as said mandrel rotates;

an internal combustion engine power plant;

a power transmitting means connecting said internal combustion engine to said mandrel cutting head;

a torque amplifying means associated with said mandrel cutting head for amplifying torque and reducing the speed of rotation of said mandrel cutting head;

and an adjustable gauge, mounted ahead of said mandrel cutting head, regulating the depth of said cut.

2. A pavement trench opening mill according to claim 1 having a cover attached to said pavement trench opening mill controlling distribution of the mill tailings pulverized by the action of said mandrel.

3. A pavement trench opening mill according to claim 1 wherein said attachment means comprises;

a slot in said frame of said trench opening mill;

said slot accommodating the bottom of said bucket;

means for attaching said pavement trench opening mill to said bucket comprising;

a hinged arm having two ends;

one end of said arm being attached to said frame of said pavement trench opening mill and the opposite end of said arm being attached to an adjustable jaw; and said jaw griping the bottom of said bucket.

4. A pavement trench opening mill according to claim 1 wherein said adjustable gauge comprises;

a depth adjustment screw having attached thereto a depth gauge shoe riding on the pavement in front of said trench opening mill;

said depth gauge shoe being attached to an internal hydraulic cylinder; said internal hydraulic cylinder being attached to a oil reservoir;

said oil reservoir having a small orifice, a ram and check valve.

5. A pavement trench opening mill according to claim 1 wherein said mandrel cutting head comprises;

multiple rows of cutting teeth spaced across the width of said mandrel cutting head;

a first row of teeth affixed at the edges of said mandrel cutting head;

a second row of teeth affixed at the edges of said mandrel, said second row of cutting teeth being spaced at a slightly decreased radius and slightly greater width than said first row of cutting teeth.

6. A method for pulverizing a trench in asphalt or concrete pavement prior to installation, repair or reinstallation of utility wires or pipes, comprising (1) attaching a pavement trench opening mill to the bucket of backhoe or front loader, said trench opening mill comprising; a frame; attachment means for firmly securing said pavement trench mill to said bucket; a mandrel cutting head having attached thereto cutting teeth desired for pulverizing asphalt and cement pavement as said mandrel rotates; an internal combustion engine power plant; a power transmitting means connecting said internal combustion engine to said mandrel cutting head; a torque amplifying means associated with said mandrel cutting head for amplifying torque and reducing the speed of rotation of said mandrel cutting head; and an adjustable gauge, mounted ahead of said mandrel cutting head, regulating the depth of said cut; (2) using said pavement trench opening mill to pulverize a trench in said asphalt or concrete, (3) detaching said pavement trench opening mill machine from said bucket, and (4) using said front loader or back hoe to remove mill tailings and deepen the trench.

* * * * *